US009637368B1

(12) United States Patent
Fox

(10) Patent No.: US 9,637,368 B1
(45) Date of Patent: May 2, 2017

(54) FLUID CAPTURING ASSEMBLY

(71) Applicant: Kevin Fox, Oakdale, NY (US)

(72) Inventor: Kevin Fox, Oakdale, NY (US)

( * ) Notice: Subject to any disclaimer, the term of this patent is extended or adjusted under 35 U.S.C. 154(b) by 58 days.

(21) Appl. No.: 14/923,572

(22) Filed: Oct. 27, 2015

(51) Int. Cl.
*B67C 11/02* (2006.01)
*B65B 39/00* (2006.01)
*G09F 15/00* (2006.01)

(52) U.S. Cl.
CPC ..... *B67C 11/02* (2013.01); *B65B 39/007* (2013.01); *G09F 15/0056* (2013.01)

(58) Field of Classification Search
CPC .... B67C 11/02; G09F 15/0056; B65B 39/007
USPC ..... 141/86, 311 A, 331, 337–338, 340–341
See application file for complete search history.

(56) References Cited

U.S. PATENT DOCUMENTS 4,245,666 A 1/1981 Norris
4,633,899 A * 1/1987 Lord ..... E04B 1/70 137/312
4,928,415 A 5/1990 Walters
5,133,167 A * 7/1992 Drew ..... E04B 9/0478 52/506.08
D329,334 S 9/1992 Kleinschmidt
5,172,718 A * 12/1992 Thornburgh ..... B67C 11/04 137/312
6,199,504 B1 3/2001 Freeman
6,283,144 B1 * 9/2001 Kahn ..... E04D 13/00 137/15.11
6,622,750 B1 * 9/2003 Bergeron ..... E04B 9/00 137/15.11
6,640,502 B2 * 11/2003 Mueller ..... E04B 9/00 137/1
7,047,681 B2 * 5/2006 Perelli ..... G09F 15/0025 116/63 P
D617,841 S * 6/2010 Jedlicka ..... D10/113.4
7,954,505 B2 * 6/2011 Odachowski ..... E04H 9/145 137/15.11
9,216,886 B2 * 12/2015 Friedlich ..... B67C 11/00
D756,831 S * 5/2016 Libbey ..... D10/113.4
2003/0115783 A1 6/2003 Woosley
2004/0231214 A1 11/2004 Bober et al.
2014/0041757 A1 * 2/2014 Kassouni ..... B67C 11/00 141/337

FOREIGN PATENT DOCUMENTS

JP 3205243 * 7/2016 ..... E04D 13/04

* cited by examiner

*Primary Examiner* — Nicolas A Arnett

(57) ABSTRACT

A fluid capturing assembly includes a sign may be positioned on a support surface thereby facilitating the sign to be visible to an observer. The sign is positioned beneath a fluid leak. A funnel is hingedly coupled to the sign such that the funnel captures fluid from the fluid leak. A bag is removably coupled to the funnel such that the bag receives the fluid.

7 Claims, 4 Drawing Sheets

FLUID CAPTURING ASSEMBLY

BACKGROUND OF THE DISCLOSURE

Field of the Disclosure

The disclosure relates to capturing devices and more particularly pertains to a new capturing device for capturing fluid from a fluid leak.

SUMMARY OF THE DISCLOSURE

An embodiment of the disclosure meets the needs presented above by generally comprising a sign may be positioned on a support surface thereby facilitating the sign to be visible to an observer. The sign is positioned beneath a fluid leak. A funnel is hingedly coupled to the sign such that the funnel captures fluid from the fluid leak. A bag is removably coupled to the funnel such that the bag receives the fluid.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
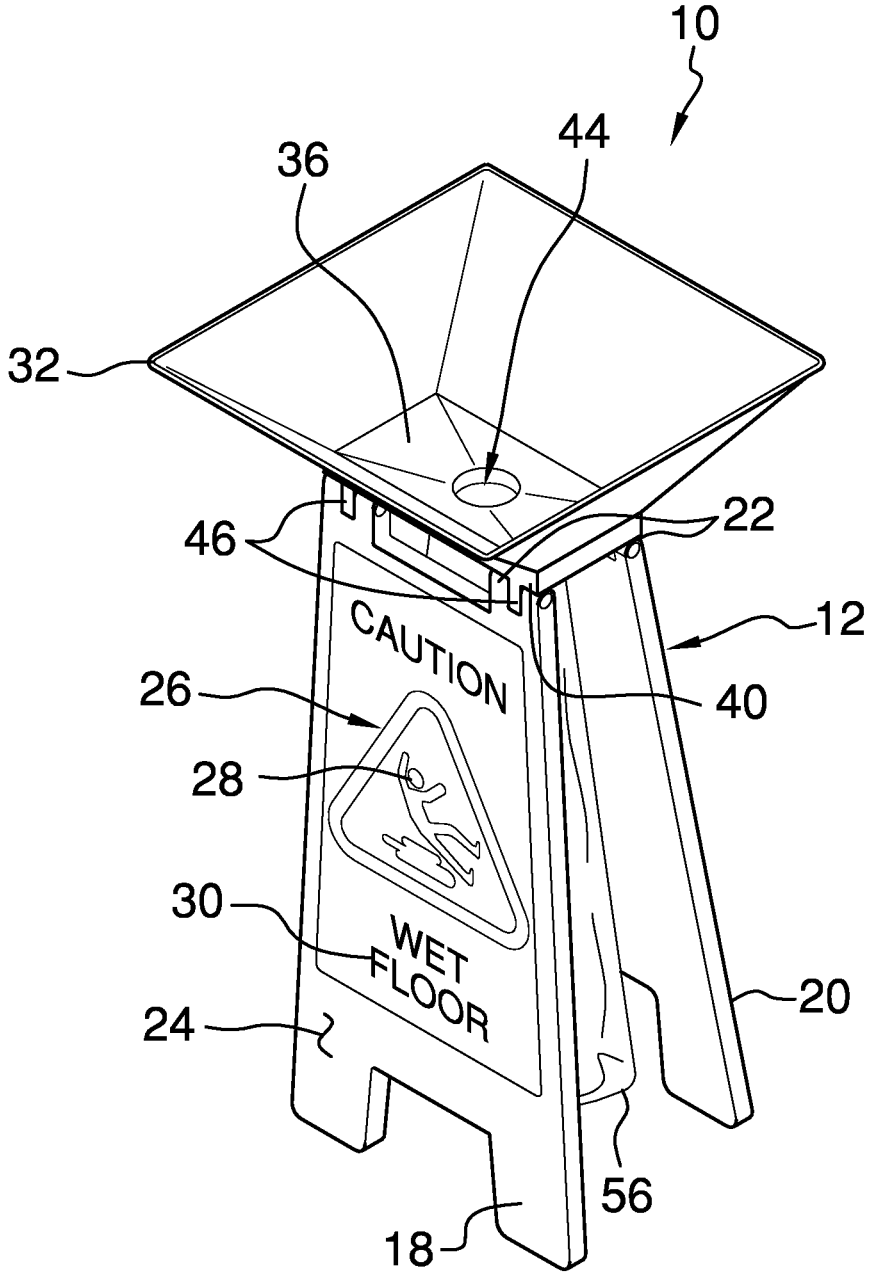
FIG. 1 is a front perspective view of a fluid capturing assembly according to an embodiment of the disclosure.
Figure 2:
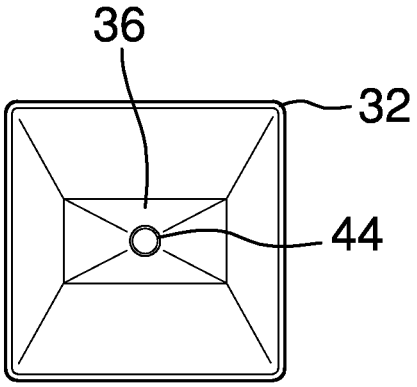
FIG. 2 is a top view of an embodiment of the disclosure.
Figure 3:
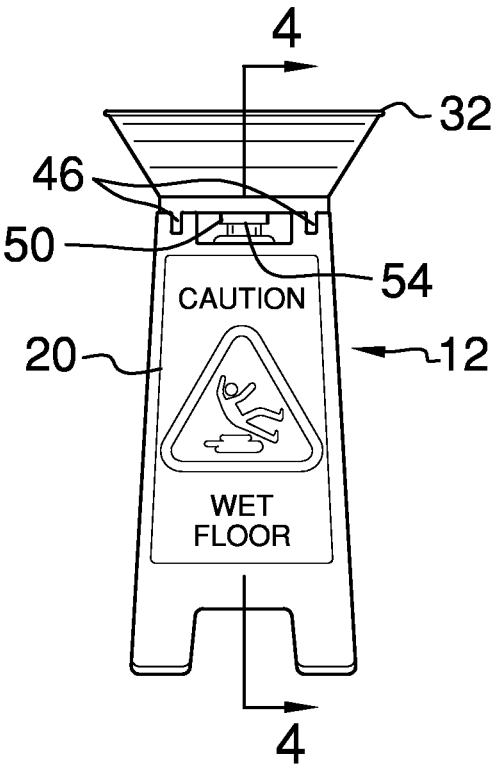
FIG. 3 is a back view of an embodiment of the disclosure.
Figure 4:
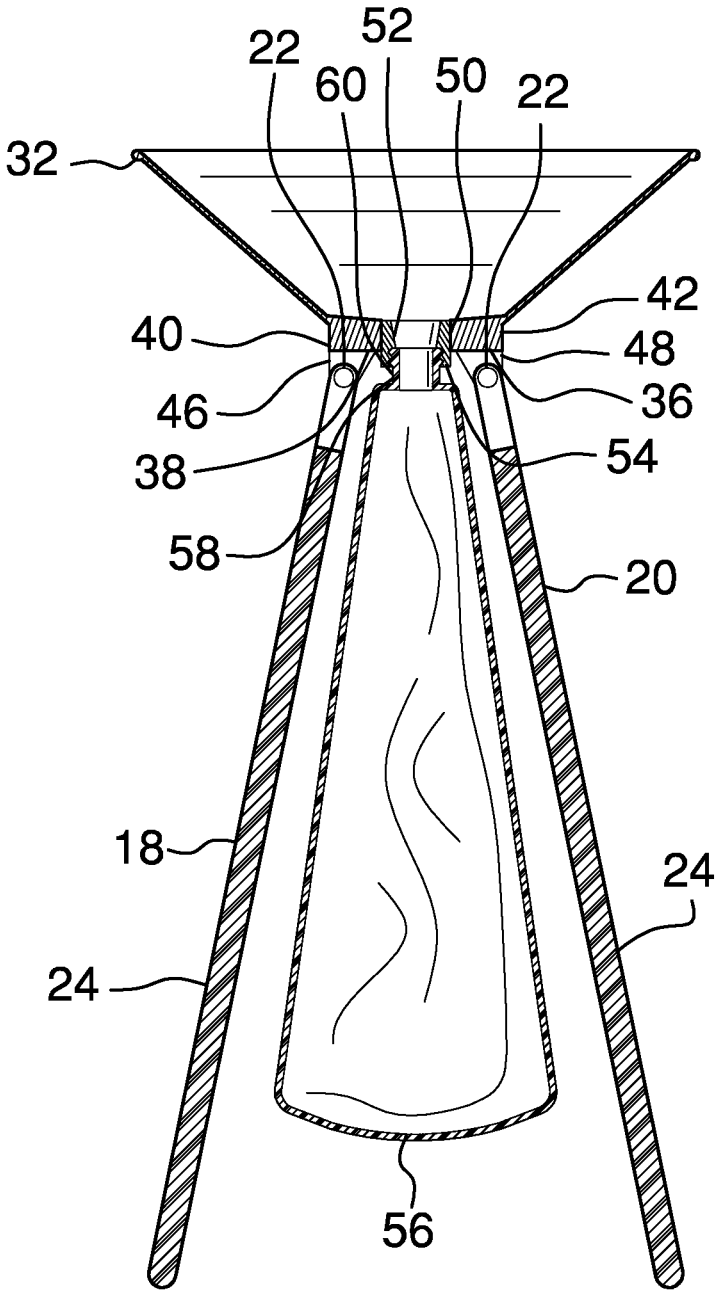
FIG. 4 is a cross sectional view taken along line 4-4 of FIG. 3 of an embodiment of the disclosure.
Figure 5:
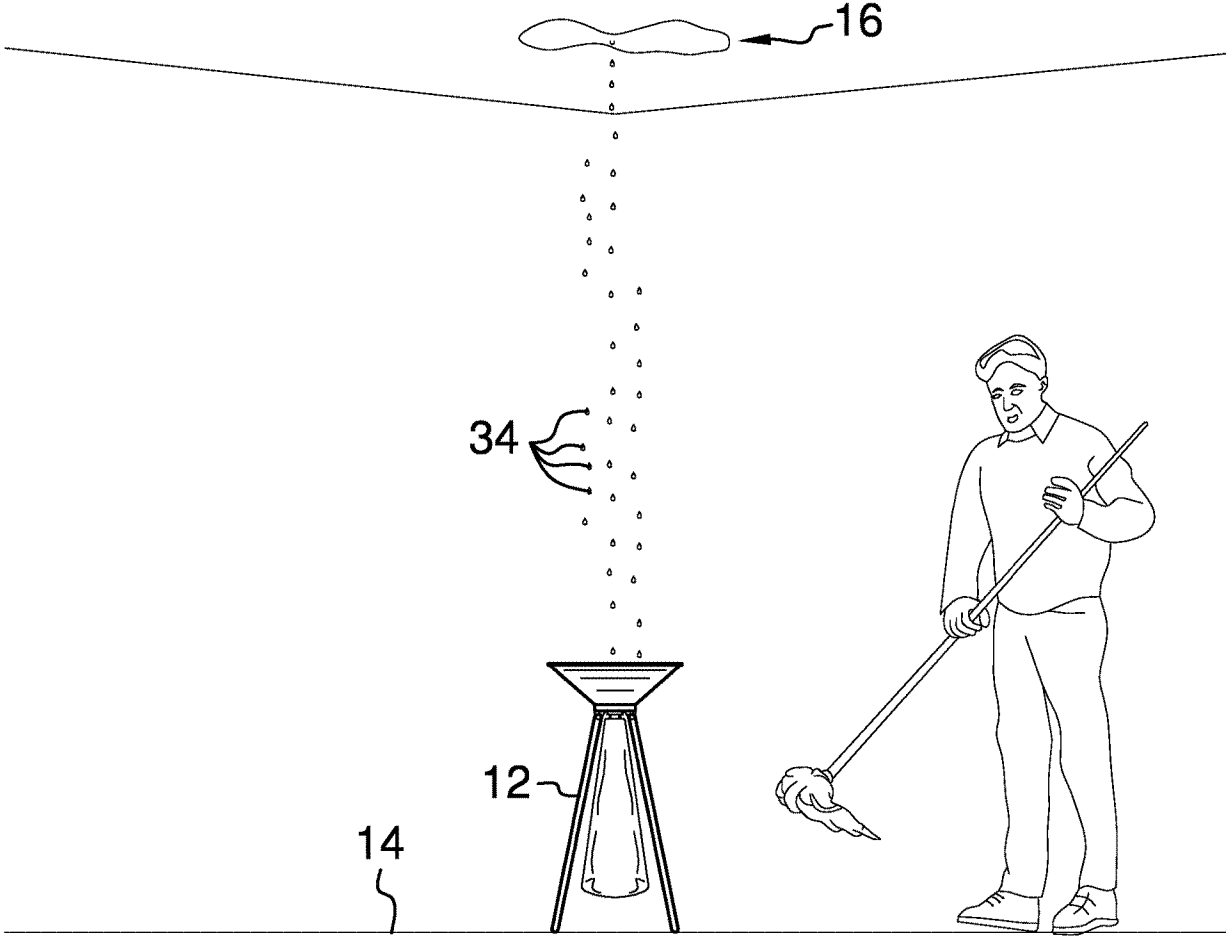
FIG. 5 is a perspective in-use view of an embodiment of the disclosure.

With reference now to the drawings, and in particular to FIGS. 1 through 5 thereof, a new capturing device embodying the principles and concepts of an embodiment of the disclosure and generally designated by the reference numeral 10 will be described.

As best illustrated in FIGS. 1 through 5, the fluid capturing assembly 10 generally comprises a sign 12 that may be positioned on a support surface 14. Thus, the sign 12 is visible to an observer. The sign 12 is positioned beneath a fluid leak 16. The support surface 14 may comprise a floor or the like and the fluid leak 16 may be a fluid leak in a ceiling or the like. The fluid leak 16 may comprise water.

The sign 12 has a first panel 18 and a second panel 20. Each of the first panel 18 and the second panel 20 has a top end 22 and an outwardly facing surface 24. The outwardly facing surface 24 of each of the first panel 18 and the second panel 20 has indicia 26 printed thereon. Thus, the indicia 26 are visible to the observer. The indicia 26 comprise a visual alert for a slipping hazard. The visual alert may include an image 28 of a slipping person or the like. The visual alert may further include the words 30 "Caution Wet Floor" or the like.

A funnel 32 is provided and the sign 12 is hingedly coupled to the funnel 32. Thus, the funnel 32 may capture fluid 34 from the fluid leak 16. The funnel 32 has a bottom wall 36 and the bottom wall 36 has a lower surface 38, a front edge 40 and a back edge 42. The bottom wall 36 has an opening 44 extending therethrough. The opening 44 may have the fluid 34 pass therethrough.

The funnel 32 includes a first set of lobes 46 and a second set of lobes 48. Each of the first set of lobes 46 and the second set of lobes 48 is coupled to and extends downwardly from the lower surface 38. Each of the first set of lobes 46 is spaced apart from each other and is distributed along the front edge 40. Each of the second set of lobes 48 is spaced apart from each other and is distributed along the back edge 42.

The top end 22 of the first panel 18 is hingedly coupled to the first set of lobes 46. The top end 22 of the second panel 20 is hingedly coupled to the second set of lobes 48. A nozzle 50 is coupled to and extends downwardly from the lower surface 38 of the funnel 32. The nozzle 50 is aligned with the opening 44 such that the nozzle 50 may have the fluid 34 pass therethrough. The nozzle 50 has an inner surface 52 and a distal end 54 with respect to the funnel 32. The distal end 54 is open.

A bag 56 is removably coupled to the funnel 32 and the bag 56 may receive the fluid 34. A nipple 58 is fluidly coupled to the bag 56 and the nipple 58 has an outer surface 60. The nipple 58 is extended into the distal end 54 of the nozzle 50 thereby facilitating the bag 56 to receive the fluid 34. The outer surface 60 of the nipple 58 threadably engages the inner surface 52 of the nozzle 50 such that the bag 56 is retained on the funnel 32. The bag 56 extends downwardly from the funnel 32 when the nipple 58 is coupled to the nozzle 50. Additionally, the bag 56 is positioned between the first panel 18 and the second panel 20 when the nipple 58 is coupled to the nozzle 50.

In use, the nipple 58 is threadably coupled to the nozzle 50. The sign 12 is positioned beneath the fluid leak 16 such the funnel 32 collects the fluid 34. The bag 56 collects the fluid 34 such that the fluid 34 is inhibited from collecting on the support surface 14. Thus, bag 56 eliminates a slipping hazard created by the fluid 34 collecting on the support surface 14. The bag 56 is removed from the sign 12 and the bag 56 is emptied when the bag 56 is filled with the fluid 34. The bag 56 is coupled to the funnel 32 after the bag 56 has been emptied if the fluid leak 16 continues. The bag 56 is removed and emptied multiple times until the fluid leak 16 is repaired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fluid capturing assembly comprising:

a sign being configured to be positioned on a support surface thereby facilitating said sign to be visible to an observer, said sign being configured to be positioned beneath a fluid leak;

a funnel being hingedly coupled to said sign wherein said funnel is configured to capture fluid from the fluid leak; and a bag being removably coupled to said funnel wherein said bag is configured to receive the fluid.

2. The assembly according to claim 1, wherein said sign has a first panel and a second panel, each of said first panel and said second panel having a top end and an outwardly facing surface, said outwardly facing surface of each of said first panel and said second panel having indicia being printed thereon wherein said indicia is configured to be visible to the observer, said indicia comprising a visual alert for a slipping hazard.

3. The assembly according to claim 1, wherein said funnel has a bottom wall, said bottom wall having a lower surface, a front edge and a back edge, said bottom wall having an opening extending therethrough wherein said opening is configured to have the fluid pass therethrough, said funnel including a first set of lobes and a second set of lobes, each of said first set of lobes and said second set of lobes being coupled to and extending downwardly from said lower surface.

4. The assembly according to claim 3, wherein:

said sign includes a first panel and a second panel, each of said first panel and said second panel having a top end; and each of said first set of lobes being spaced apart from each other and being distributed along said front edge, each of said second set of lobes being spaced apart from each other and being distributed along said back edge, said top end of said first panel being hingedly coupled to said first set of lobes, said top end of said second panel being hingedly coupled to said second set of lobes.

5. The assembly according to claim 3, wherein said funnel has a nozzle being coupled to and extending downwardly from said lower surface, said nozzle being aligned with said opening wherein said nozzle is configured to have the fluid pass therethrough, said nozzle having an inner surface and a distal end with respect to said funnel, said distal end being open.

6. The assembly according to claim 5, wherein said bag has a nipple being coupled thereto, said nipple having an outer surface, said nipple being extended into said distal end of said nozzle thereby facilitating said bag to receive the fluid, said outer surface of said nipple threadably engaging said inner surface of said nozzle such that said bag is retained on said funnel.

7. A fluid capturing assembly comprising:

a sign being configured to be positioned on a support surface thereby facilitating said sign to be visible to an observer, said sign being configured to be positioned beneath a fluid leak, said sign having a first panel and a second panel, each of said first panel and said second panel having a top end and an outwardly facing surface, said outwardly facing surface of each of said first panel and said second panel having indicia being printed thereon wherein said indicia is configured to be visible to the observer, said indicia comprising a visual alert for a slipping hazard;

a funnel being hingedly coupled to said sign wherein said funnel is configured to capture fluid from the fluid leak, said funnel having a bottom wall, said bottom wall having a lower surface, a front edge and a back edge, said bottom wall having an opening extending therethrough wherein said opening is configured to have the fluid pass therethrough, said funnel including a first set of lobes and a second set of lobes, each of said first set of lobes and said second set of lobes being coupled to and extending downwardly from said lower surface, each of said first set of lobes being spaced apart from each other and being distributed along said front edge, each of said second set of lobes being spaced apart from each other and being distributed along said back edge, said top end of said first panel being hingedly coupled to said first set of lobes, said top end of said second panel being hingedly coupled to said second set of lobes, said funnel having a nozzle being coupled to and extending downwardly from said lower surface, said nozzle being aligned with said opening wherein said nozzle is configured to have the fluid pass therethrough, said nozzle having an inner surface and a distal end with respect to said funnel, said distal end being open; and a bag being removably coupled to said funnel wherein said bag is configured to receive the fluid, said bag having a nipple being coupled thereto, said nipple having an outer surface, said nipple being extended into said distal end of said nozzle thereby facilitating said bag to receive the fluid, said outer surface of said nipple threadably engaging said inner surface of said nozzle such that said bag is retained on said funnel.

* * * * *